US007857739B2

(12) United States Patent
Caldwell

(10) Patent No.: US 7,857,739 B2
(45) Date of Patent: Dec. 28, 2010

(54) EXERCISE FRAME

(76) Inventor: Willie Caldwell, 11612 Breeze Grass Way, Parker, CO (US) 80134

( * ) Notice: Subject to any disclaimer, the term of this patent is extended or adjusted under 35 U.S.C. 154(b) by 0 days.

(21) Appl. No.: 12/270,866

(22) Filed: Nov. 14, 2008

(65) Prior Publication Data

US 2009/0069161 A1 Mar. 12, 2009

Related U.S. Application Data

(63) Continuation-in-part of application No. 11/559,896, filed on Nov. 14, 2006, now abandoned.

(51) Int. Cl.
*A63B 21/04* (2006.01)
*A63B 21/00* (2006.01)

(52) U.S. Cl. ..... 482/133; 482/130

(58) Field of Classification Search ..... 482/78, 482/904, 907, 35–36, 83, 87, 91–92, 121, 482/123, 129–130, 908
See application file for complete search history.

(56) References Cited

U.S. PATENT DOCUMENTS

| | | | | |
|---|---|---|---|---|
| 4,880,227 | A | 11/1989 | Sowell | |
| 5,100,128 | A * | 3/1992 | Mabry et al. | 482/134 |
| 5,123,886 | A * | 6/1992 | Cook | 482/129 |
| 5,277,685 | A * | 1/1994 | Gonzales | 482/134 |
| 5,362,297 | A | 11/1994 | Muit | |
| 5,385,525 | A | 1/1995 | Davis | |
| 5,803,885 | A | 9/1998 | Tiller | |
| 5,839,995 | A | 11/1998 | Chen | |
| 5,971,897 | A | 10/1999 | Olson et al. | |
| 6,142,919 | A | 11/2000 | Jorgensen | |
| 6,220,992 | B1 * | 4/2001 | Shafik | 482/83 |
| 6,539,569 | B2 | 4/2003 | O'Connell | |
| 6,632,160 | B2 | 10/2003 | LaFond et al. | |
| 6,712,744 | B2 | 3/2004 | Buechel, Jr. et al. | |
| 6,887,190 | B1 | 5/2005 | Azari | |
| 7,156,789 | B2 | 1/2007 | Nativ | |

* cited by examiner

*Primary Examiner*—Nicholas D Lucchesi
*Assistant Examiner*—Sundhara M Ganesan
(74) *Attorney, Agent, or Firm*—Kyle W. Rost

(57) ABSTRACT

A floor plate is suitably sized to receive a wheelchair and also supports a base frame along rear and side edges. Prepositioned brackets on the floor plate secure the base frame using quick-connect fasteners. Opposite side portions of the base frame carry elevated, horizontal, tubular, side housings that telescope over elongated exercise bars. A fastener secures each exercise bar in a housing at a variably selected degree of insertion. An upright tube at the rear of the base frame has an open top forming a socket. An upright standard engages the socket and carries an overhead bar supporting a transverse crossbar over the center of the floor plate. The ends of the crossbar, the front ends of exercise bars, the front end of the floor plate, and various other locations on the base frame carry C-shaped attachments for clip-on resistance members. The attachments are sized to serve as handgrips. Casters on the rear edge of the floor plate are moved into ground-engaged positions with the upward tilting of the front of the floor plate, which is aided by the use of handgrip attachments on the front of the floor plate. Fasteners securing the base frame to all other components are quickly released for rapid disassembly of the exercise frame, enabling it to be transported by hand or by vehicle to a next site.

2 Claims, 4 Drawing Sheets

EXERCISE FRAME

CROSS-REFERENCE TO RELATED APPLICATION

This patent application is a continuation-in-part of U.S. patent application Ser. No. 11/559,896 filed Nov. 14, 2006, copending.

BACKGROUND OF THE INVENTION

1. Field of the Invention

The invention generally relates to exercise devices that provide support for the entire body. More specifically, the exercise frame is of the type that utilizes resilient force as resistance, with user supplied counter force against a user occupied platform. The invention is an exercise frame with a uniquely portable frame that provides wide adjustability to the needs of the user.

2. Description of Related Art Including Information Disclosed Under 37 CFR 1.97 and 1.98

Exercise frames are known in many configurations. The typical purpose of an exercise frame is to provide a supporting and anchoring structure for resistance elements and devices while a user is exercising. Thus, such exercise frames may be a part of a weightlifting system or another type of exercise system, such as a system employing elastic cords as resistance elements.

As special need exists for an exercise frame that is highly portable. This need relates to the work of therapists and trainers who bring equipment with them to a user's location. Although various exercise frame or devices are foldable or capable of convenient storage, they do not offer realistic capability to be assembled and disassembled in minutes. Neither do they offer the realistic capability to be carried in manageable subassemblies by a single person over considerable distance. Further, they do not offer the realistic capability to be loaded into a single passenger automobile that is sized on the order of a station wagon.

All of these capabilities are required in order for many therapists and trainers to call upon a significant plurality of clients per day. In some cases, the client cannot conveniently travel to the trainer or to a gym, making it highly important that the trainer can travel with his equipment to the client. Thus, the subcomponents of an exercise frame should be easy to handle and should include aids for lifting and carrying.

It would be beneficial for the exercise frame to be configured with attachments for anchoring resilient force elements from a wide variety of positions, thus enabling exercises to originate from many directions. In a frame with transportable components, it would be desirable for the attachment points to be configured and arranged to aid in assembly, disassembly, and movement of subcomponents.

Some such clients may be limited in their movements or confined to wheelchairs. Consequently, a suitable portable exercise frame should meet the additional qualification of being suited for use by a seated user, such as a user in a wheelchair. A variety of exercise frames are adapted for use by wheelchair users, but none are known to meet the full range of aforementioned requirements.

In the general art of exercise devices, typical known devices are not necessarily able to provide a wide range of exercise, accommodate wheelchairs, and enable rapid portability. Some employ limited features also found in the present invention. For example, U.S. Pat. No. 6,887,190 to Azari shows an exercise frame that employs tension members clipped to any of a variety of eyelets, some at high locations and others at low locations. However, this frame is not highly portable and the eyelets are not adapted to assist in assembly, disassembly, and movement of subcomponents.

U.S. Pat. No. 6,632,160 to LaFond shows an exercise frame built on a base plate and carrying an adjustable overhead bar with transverse crossbar. However, this frame is not highly portable and offers substantially limited forms of exercise.

U.S. Pat. No. 6,220,992 to Shafik shows a multiple purpose exercise frame that supports boxing equipment such as a punching bag and heavy bag on variably positioned supports. This type of exercise equipment does not lend itself to the portability needed for purposes of the present invention.

Additional general background is found in U.S. Pat. No. 6,142,919 Jorgensen, which shows the use of elastic resistance members to provide tension. U.S. Pat. No. 5,971,897 to Olson shows a frame with adjustable height for a specific exercise component. U.S. Pat. No. 5,385,525 to Davis shows a small and simple exercise device for use in a shower, and this device is transportable. None of these devices provides equivalent functions and advantages as the present invention.

A number of exercise devices can accommodate a wheelchair. U.S. Pat. No. 5,362,297 Muir shows an exercise frame with operator cage to receive a wheelchair. A lap restraint arm is specifically suited to support a user in a wheelchair. This exercise frame clearly is not portable in the way required for purposes of the present invention.

U.S. Pat. No. 5,100,128 to Mabry shows an exercise frame with operator area receiving a wheelchair that is strapped in place. However, this exercise frame employs fixed weight and is not reasonably portable.

U.S. Pat. No. 4,880,227 to Sowell shows an exercise frame suited for use by an operator in a wheelchair. Various exercise appliances are slidable on the frame to be within reach of the operator seated at a single station. However, this frame is not reasonably portable within the needs of the present invention.

Accordingly, the present invention provides an exercise frame that meets the needs of trainers and therapists who transport exercise equipment to the location of the user. The exercise frame is versatile and enables a wide variety of exercises. The exercise frame also is well suited to the needs of those in a wheelchair. In addition, the exercise frame employs multi-function components to aid in handling the assembly, disassembly, and movement of the frame.

To achieve the foregoing and other objects and in accordance with the purpose of the present invention, as embodied and broadly described herein, the method and apparatus of this invention may comprise the following.

BRIEF SUMMARY OF THE INVENTION

Against the described background, it is therefore a general object of the invention to provide a strong and versatile exercise frame that also is disassembled and reassembled with ease, allowing the exercise frame to be transported as desired.

According to the invention, a portable exercise frame is convertible between assembled and disassembled configurations. In the assembled configuration, a floor plate defines an operator area and is suitably sized to receive a user, optionally in a wheelchair. The floor plate carries a base frame. Portions of the base frame include opposite, first and second side frames located near opposite, first and second side edges of the floor plate. Another portion of the base frame is a rear frame located near a rear edge of the floor plate. The opposite, first and second side frames each including an upstanding portion carrying a respective first and second longitudinally elongated side housing spaced above the floor plate. The side housing defines a passage oriented from front-to-rear of the floor plate. First and second longitudinally elongated exercise bars are telescopically received in the passages of the respective first and second side housings. Fasteners releasably secure the first and second longitudinally elongated exercise bars in a selected position through the respective side housings, chosen from a plurality of available positions. A plurality of anchoring members is configured suitably for, in use, attaching a resistance element to the exercise frame when the frame is in assembled configuration. The anchoring members are suitably configured for hand engagement to aid in carrying disassembled portions of the exercise frame when in disassembled configuration. At least some of said anchoring members are mounted to the floor plate, to the base frame, and to the exercise bars.

The accompanying drawings, which are incorporated in and form a part of the specification, illustrate preferred embodiments of the present invention, and together with the description, serve to explain the principles of the invention. In the drawings:

DETAILED DESCRIPTION OF THE INVENTION

The invention is a mobile exercise frame 10 that is especially suited for use by an operator or user who is in a wheelchair, although its use is not limited to that application. In fully assembled configuration, the exercise frame 10 is able to provide a full range of body exercise, using resilient cords as a source of resistance. The cords are secured to the frame or platform, and the operator supplies counter force against a operator occupied platform. An important feature is that the frame is capable of being disassembled with speed and ease, reducing the frame 10 to components that are readily carried and transported to different sites. The components are sized to fit into a normal automobile of size similar to a station wagon. Correspondingly, the components of the exercise frame 10 are conveniently sized to be carried into a new location and quickly assembled there.

The exercise frame 10 is formed of a limited number of components. These components are joined together by connections that can be secured by a removable pin so that assembly and disassembly of the frame requires no tools. The connections typically will be by overlapped walls of mated components carrying one or more aligned apertures. The removable pin is inserted or removed from an aligned aperture to assemble or disassemble the components. The components are a floor plate, a base frame that mates with the floor plate, a pair of elongated arms that mate with the base frame, an overhead frame that mates with the base frame, and a body support member that mates with the base frame. Thus, the base frame mates with all of the other components and provides a supporting structure that unites the various components into the assembled exercise frame 10.

Figure 1:
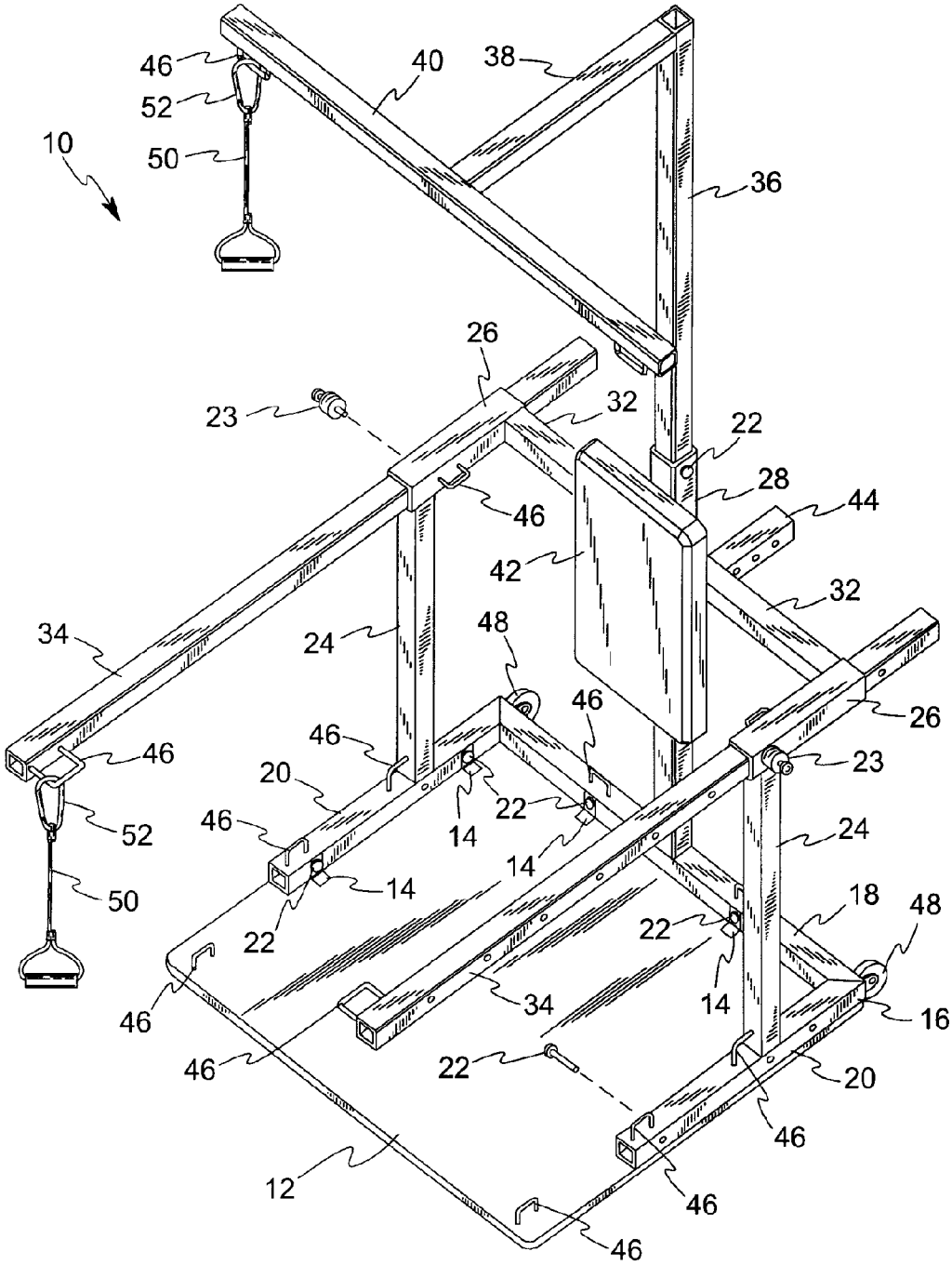
FIG. 1 is an isometric view of the assembled exercise frame, taken from a front right elevated viewpoint, and showing a representative number of fasteners in exploded position.
Figure 2:
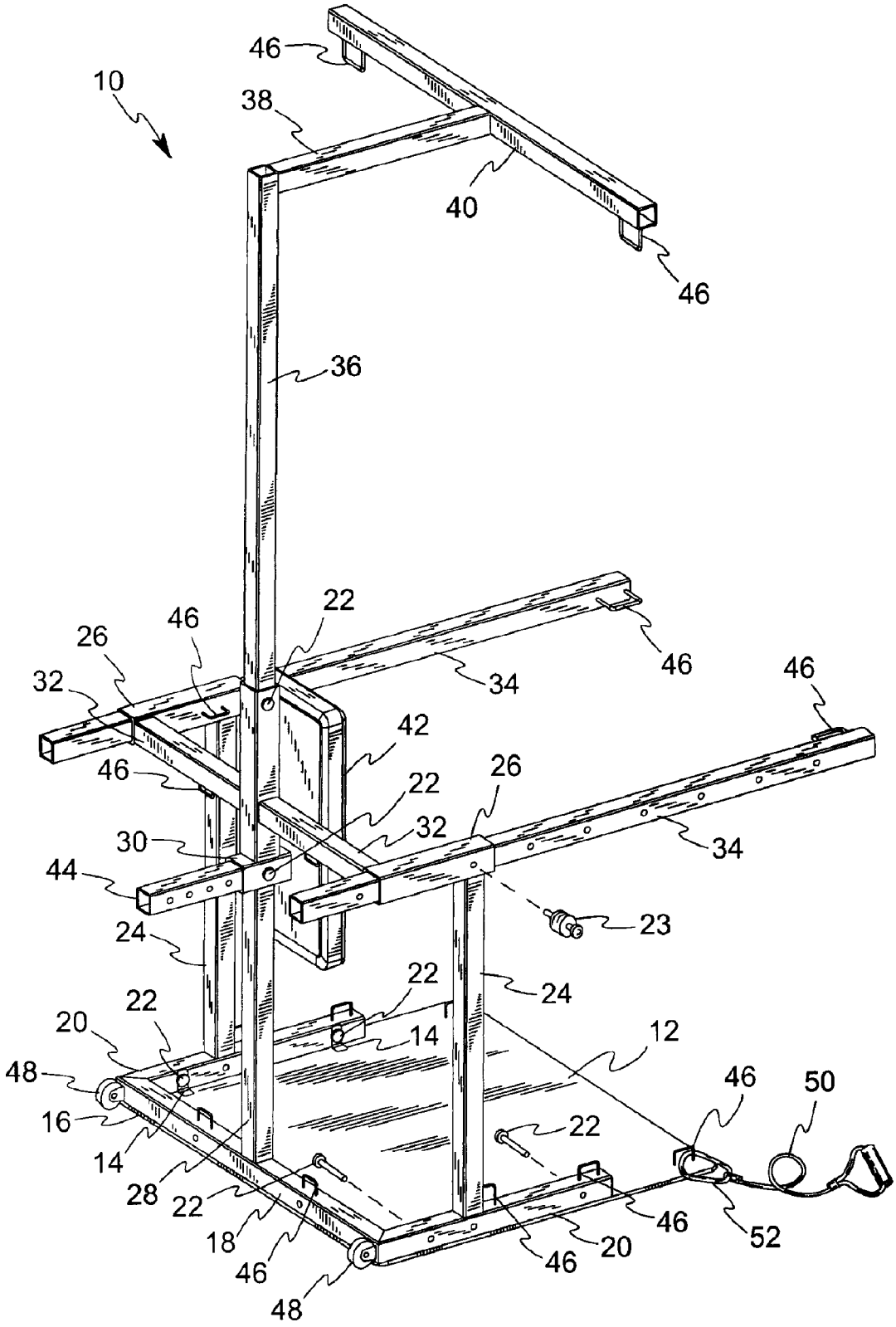
FIG. 2 is an isometric view thereof, taken from a left rear elevated viewpoint, and showing a representative number of fasteners in exploded position.

With reference to FIGS. 1 and 2, the exercise frame 10 includes a floor plate 12 that defines an operator area. The size of the floor plate is suitable to receive a wheelchair so that, optionally, the user can remain in a wheelchair during exercise. A suitable size of the floor plate is a rectangle of about thirty-six inches from front-to-rear and about forty inches from side-to-side. The entire exercise frame 10 can be lightweight, for example formed of aluminum, because the floor plate 12 will carry the weight of the operator. Thus, the operator provides stability by locating his own mass upon the floor plate 12 during use.

The floor plate 12 is a generally rectangular plate and is equipped with peripheral fittings or brackets 14 for defining a reception area on the floor plate for receiving a base frame 16. In addition, the brackets 14 connect the base frame 16 to the plate 12. The fittings 14 may be angle brackets having one arm welded to the floor plate 12 to fix the brackets in predetermined positions. The second arm of each bracket 14 is upstanding and spaced inwardly from the periphery of the floor plate 12 by the approximate thickness of base frame members, further described below. This inward spacing may be about two inches.

The bottom of base frame 16 rests on the floor plate during use. The bottom of base frame 16 is sized to fit the perimeter of the floor plate at a predetermined position, which preferably is along rear edge thereof and at contiguous portions of each side edge thereof. The bottom of base frame 16 defines a three-sided rectangle with an open front allowing a wheel chair to enter the operator's area defined by the central portion of the floor plate 12. The base frame 16 can be viewed as composed of three sub-frames. One sub-frame is a rear frame, and two additional sub-frames are side frames. The rear frame includes a rear bar 18 that extends along the rear edge of the floor plate. The rear bar is similar in length to the width of the floor plate, which as noted above may be about forty inches.

The rear frame is connected to the two side frames. Rear bar 18 is connected at its opposite ends to a pair of sidebars 20 that extend along the opposite sides edges of the floor plate. The sidebars 20 extend from the rear edge of the floor plate toward the front edge. The sidebars 20 are the bottom portions of the two side frames. The sidebars 20 extend over only a part of the front-to-rear distance of the floor plate 12, such as about two-thirds of this distance or about two feet.

At least two brackets 14 connect each of the bottom edge bars 18, 20 to the floor plate. The brackets 14 may be welded to the top surface of floor plate 12 in suitable positions to mate against the bottom bars of a properly positioned base frame 16. The upright arm of each fitting defines a fastening aperture. The base frame bars 18, 20 each define a matching transverse aperture to each of the corresponding bracket apertures so that the base frame 16 can be secured to the brackets 14 when the base frame is in its predetermined, proper position with respect to the floor plate 12.

Removable fasteners 22 are inserted through the aperture of each bracket and into the matching aperture in the base frame during assembly. The fasteners 22 are generally pin fasteners. More specifically, each may be of any known type of quick-connect fasteners, although bolts or bolts with nuts also might be used. Preferred quick-connect fasteners include clevis pins, detent ring pins, bow-tie locking cotter pins, lynch pins, or pressure screws. Suitable quick-connect fasteners are of the type that, to be inserted, can be pushed through the aligned holes of the two components and can be removed by pulling. A detent or similar spring-loaded feature of such a fastener will provide positive retention while allowing the fastener to be pulled out for quick disassembly. Similar fasteners 22 can be used throughout other portions of the assembly.

The side frames of base frame 16 each include an attached upright portion 24, which typically is welded to a base frame bar 20. Each of the two opposite sidebars 20 carries an attached upright side frame 24. A horizontal side housing 26, preferably formed of square tubing, tops each upright side frame 24. The tubing enables each side housing 26 to telescopically receive a carried bar 34 that is longitudinally elongated and formed of suitably sized square tube, as described below. Solely for convenience of reference, throughout this description and the claims that follow, the elongated bars 34 that are received in the side housings 26 may be referred to as exercise bars.

The side housings 26 are preferred to be substantially shorter than the front-to-rear dimension of the floor plate, so as to reveal most of the length of a carried exercise bar 34. A suitable length of a side housing 26 is about one foot. These side housings 26 preferably are positioned with a rear end of each lying at the vertical rear plane of the floor plate and extending forward there from. The upright portions 24 of the base frame 16 are suitably sized to carry the housings 26 at about the shoulder height of a seated user, such as a user in a wheelchair. A suitable height for upright portions 24 is about two and one-half to three feet above the floor plate 12. The exercise bars 34 are carried at about this specified height above the floor plate 12.

The rear frame of base frame 16 carries an upright, vertical tube 28, which may be welded to the rear member 18 near the center of its length. At a position about two feet above rear member 18, the central vertical tube 28 carries a horizontal housing 30. The housing 30 has a hollow core that is longitudinally oriented from front-to-rear of the floor plate. Housing 30 will be referred to as a central housing.

Above the horizontal, central housing 30, the vertical tube 28 defines a vertical socket housing with open top. The socket housing may be an additional length of square tubing that is welded to the top of horizontal, central housing 30. The vertical socket housing will be considered herein to be a further extension of vertical tube 26. Therefore, the socket housing is considered to be the top portion of vertical tube 28. The socket housing is suited to receive an overhead frame, described below. A suitable length for the socket housing is about fifteen inches. A side wall of the socket housing and a side wall of the central housing 30 each define a transverse aperture suitably sized to receive a pin fastener 22.

The vertical tube 28 of the rear frame is connected to each of the side frames. Preferably, right and left junction rods 32 are welded at one end to the tube 28 and at the second end to a respective one of the horizontal side housings 26. The junction rods 32 and rear bar 18 lie along the vertical rear plane of the floor plate. Each horizontal side bar 20, the attached upright frame 24, and the attached side housing 26 may lie along a vertical side plane of the floor plate. The upright side frames 24 are at least partially forward of the rear plane and establish a strong, truss-like structure in the construction of the base frame 16. The complete base frame is about forty-three inches high at the top of vertical bar 28, forty inches wide, and about two feet long at the side frame bars 20. This size is easily handled and moved through doorways. The base frame 16 has an open front, which further aids movement around obstacles in confined areas.

As noted previously, each of the horizontal side housings 26 slidably or telescopically receives a longitudinally elongated horizontal exercise bar 34. The exercise bars 34 may be formed of square tubing having a cross-section size that fits telescopically inside the square tube of a housing 26 by sliding in or through the hollow core of the side housing. The cross-sectional sizes of the side housings 26 and exercise bars 34 are suitable to permit free sliding between them, while engagement with the square cross-sectional profile of housings 26 prevents the exercise bars 34 from substantial twisting about the longitudinal axis. A side housing may have a two and one-half inch wall length in cross-section. An exercise bar 34 may have a two-inch wall length in cross-section, which suitably fits through the hollow center of a side housing 26 when standard square tubing is used. Each exercise bar 34 is longer than the front-to-rear dimension of the floor plate 12, which enables the exercise bar to be engaged in a side housing 26 while extending beyond the front edge of the floor plate. A suitable length for an exercise bar 34 is about five feet.

An exercise bar 34 can be secured in any of a variety of positions with respect to a telescoped side housing 26. For example, the aperture formed in the sidewall of each side housing 26 may carry a fastener 22, which can be a setscrew or a quick-connect device that can be engaged in an aligned transverse aperture in an exercise bar 34. Performing exercises on the assembled frame 10 can benefit from frequent repositioning of the exercise bars 34. For this reason, a preferred fastener 23 is installed on side housings 26. Fastener 23 is a cartridge composed of a keeper holding a spring-loaded pin. The cartridge 23 semi-permanently mounts to the aperture of housing 26. The keeper retains the moveable fastening pin while allowing the pin to be moved into or out of engagement with the exercise bar 34.

Each of the exercise bars 34 defines a series of longitudinally spaced apertures. For example, an exercise bar may define a series of apertures at six-inch spacing. A fastener 22 in the side aperture of a housing 26 can be engaged with any of the apertures in the series defined by exercise bar 34. Thus, such a fastener can lock the position of the exercise bar at any of a variety of preselected positions with respect to the side housing 26. Therefore, although the exercise bar may be about five feet in length, a substantial portion of this length can be moved rearward of the side housings 26, if desired.

The base frame 16 supports an overhead frame at the top socket of vertical bar 28. A vertical standard 36 of the overhead frame fits into the top socket of vertical bar 28. A side wall of the vertical standard 36 defines an aperture that aligns with the aperture of the vertical socket when the standard is bottomed in the socket. A pin fastener 22 is inserted through the aligned apertures between the two components. A suitable vertical length for the standard is about sixty-four inches.

Near its top, the vertical standard 36 carries an overhead bar 38 that extends forward over the operator area of the floor plate 12. At a forward end, the overhead bar 38 carries a transverse crossbar 40, forming a T-shaped horizontal, overhead structure. The crossbar 40 has a width similar to or wider than the width of the floor plate 12. The length of the overhead bar 38 is sufficient to locate the crossbar 40 over a central part of the operator area of the floor plate 12. A suitable length for the overhead bar is about twenty-two inches. A suitable length for the crossbar is about four feet.

The base frame 16 provides support for a body support member. The base frame carries a torso support pad 42 of the body support member. A user can employ the torso support pad 42 as either a backrest or a chest rest, especially when the user is seated in a wheelchair. A depth adjustment bar 44 is carried on the rear of the torso support pad 42 and defines a closely spaced series of apertures. Central housing 30 receives the adjustment bar 44. A suitable length for the depth adjustment bar 44 is about fourteen inches, and a suitable spacing of apertures through the bar 44 is about two inches.

The pad 42 extends into the operator area by a depth that is adjusted by locking the adjustment bar 44 to the central housing 30 at the desired relative position. A fastener 22 is inserted through the aperture of the central housing and a selected aperture of the adjustment bar 44 to select the position of the torso support pad 42.

Anchors 46 are attached at various positions to other components of the exercise frame 10 to provide attachment points for resistance elements such as elastic cords. The anchors also are configured to provide convenient handgrips for assembling, disassembling, and moving components of the exercise frame. At least some of the anchors 46 may be U-shaped and of about a three inch width so that they are easily engaged by hand. These anchors are especially useful for lifting and carrying the various component assemblies of the exercise frame 10. Anchors 46 that are configured as handgrips are located at the forward end of each exercise bar 34, at the opposite ends of the overhead crossbar 40, at the front end of each side bar 20, and at the front edge of the floor plate 12. Anchors in these positions are a substantial aid to the portability of the exercise frame 10 when it is in disassembled configuration.

In the assembled exercise frame 10, the anchors 46 are located at near floor-level positions, mid-level positions, and overhead positions to enable a range of full body exercises. For example, two low anchors 46 are carried on each of the two sidebars 20. These include the front anchors described above and midpoint, L-shaped anchors that are connected between each sidebar 20 and its upright side frame 24. Two additional low anchors 46 are carried on the top face of rear bar 18. The rear bar anchors may be slightly smaller than the handgrip anchors. Two more low anchors 46 are attached to the floor plate near its front edge, as previously described. If desired, low level anchors can be used to secure a wheelchair to the floor plate 12 during exercise, using elastic cords. The floor plate also carries a pair of caster wheels 48 at the rear edge. The anchors 46 on the front edge of the floor plate can serve the additional function of lifting grips for tilting the assembled exercise frame 10 onto the rear caster wheels 48 for minor local movement of the entire frame 12.

The front end of each horizontal exercise bar 34 carries a mid-level anchor, as previously described. Two additional mid-level anchors are carried on the bottom face of junction rods 32. These may be of the smaller size and are directly opposite the similar anchors on the top face of the rear bar 18. Another two mid-level anchors are carried on the center-facing walls of side housings 26. As also previously described, the crossbar 40 carries two overhead anchors 46.

Elastic cords 50 provide resistance force for exercises. On one end, each cord 50 carries a closed fastener 52 that can engage any of the anchor rings. Suitable fasteners include a carabiner, eyehook, or gated spring clip. The opposite end of each cord 50 carries a handgrip.

In use of the assembled frame 10, the operator, trainer or therapist can clip fasteners 52 of cords 50 to any of the anchors 46 to position the cords for use in exercise. As may be required, the positions of some anchors 46 are adjustable to conform to the user's body size, exercise position, or other preferences. The anchors are adjustable at least by moving the horizontal exercise bars 34 to a new position within housings 26. Thus, it is possible for a user to conduct exercises with resistance members attached from low, mid-level, or overhead positions.

The specific exercises and elastic cord attachments are selectable according to the needs and desires of the user. The exercise frame offers a stable and versatile platform for exercising all parts of the body. A user not in a wheelchair can substitute an ordinary exercise bench in the operator area.

The widely adjustable exercise arms 34 offer particular advantage. The anchors 46 near the front ends of the arms 34 can be placed anywhere from a full forward position to a full rearward position. In full forward position of the arms 34, the attached anchors 46 are nearly five feet in front of the rear plane of the frame 10. As indicated, above, the anchors 46 are of suitable size to be convenient handgrips. The fully forward position of arms 34 and attached anchors 46 offers assistance and guidance for a user moving a wheelchair into the operator area. If the arms 34 are moved as far back as possible in housings 26, the attached anchors 46 are only about a foot in front of the rear plane of the frame 10. If desired for any reason, the arms 34 could be reversed in direction and inserted from the rear of housings 26 to extend from the rear of the frame 10. Such reverse placement of the arms 34 would open the sides of the operator area of frame 10 to accommodate an appropriate situation.

The frame 10 is easily and quickly assembled for use. The floor plate 12 can be carried by attached front anchors 46 or wheeled on rear casters 48 to a desired position and then placed on a floor. The base frame 16 is set upon the floor plate, guided by the pairs of side and rear brackets 14. The spacing of brackets 14 from the juxtaposed edges of the floor plate is approximately the thickness of the tubing forming the base frame 16, such that the base frame is accurately guided to its proper position wherein apertures of the base members 18, 20 are aligned with the apertures of corresponding brackets 14. Fasteners 22 are inserted through the accurately aligned apertures to temporarily secure the base frame 16 to the floor plate 12. With this single assembly step, the partial frame provides anchors at low and mid-level and can be used for many exercises.

In most cases, it is desirable to slide each the two exercise arms 34 into a respective housing 26 and align the aperture of the housing 26 with any one of a series of apertures spaced along arm 34. The pin of fastener cartridges 23 is pulled back for receiving the arms 34 into the housings 26. The pin is moved forward to temporarily secure the arm 34 in one of the available positions. With this second assembly step, the partial frame provides anchors at an expanded and variable range of mid-level positions and can be used for an expanded range of exercises. Optionally, the torso rest 42 can be positioned, if desired, by inserting adjustment bar 44 through central housing 30 and aligning the aperture of housing 30 with a selected one of several available apertures spaced along bar 44. A fastener 22 is inserted through the aligned apertures to temporarily secure the torso pad in one of the available positions.

In order to fully assemble the frame 10, standard 36 is inserted into the top socket of vertical bar 28. The standard 36 bottoms in the top socket when in fully inserted position. For example, the standard can bottom against the top wall of central housing 30. An aperture through the standard 36 and an aperture through the vertical bar 28 are prepositioned to align when the standard 36 is bottomed in the socket. A fastener 22 is inserted through the aligned apertures to temporarily secure the standard 36 in the vertical socket. With this third and final assembly step, the frame 10 provides anchors additionally at overhead positions for a still further expanded range of exercises.

The frame 10 is disassembled by the reverse steps. Removing the one fastener 22 from vertical bar 28 and standard 36 releases the standard 36 for removal from engagement with the top socket of vertical bar 28. Pulling back the spring-loaded pin of fastener cartridge 23 from each side housing 26 releases each exercise arm 34 for removal from engagement with a side housing 26. Removing each of the fasteners 22 from the brackets 14 on the floor plate 12 releases the base frame 16 for removal from floor plate 12. Removing one fastener 22 from central housing 30 releases adjustment bar 44 for removal of the torso pad 42 from housing 30. The disassembled components are small enough and lightweight enough to be carried comfortably by hand. Typically, the disassembled components can be compactly lashed together on a small hand truck for convenient movement as a single bundle to or from an automobile.

Figure 3:
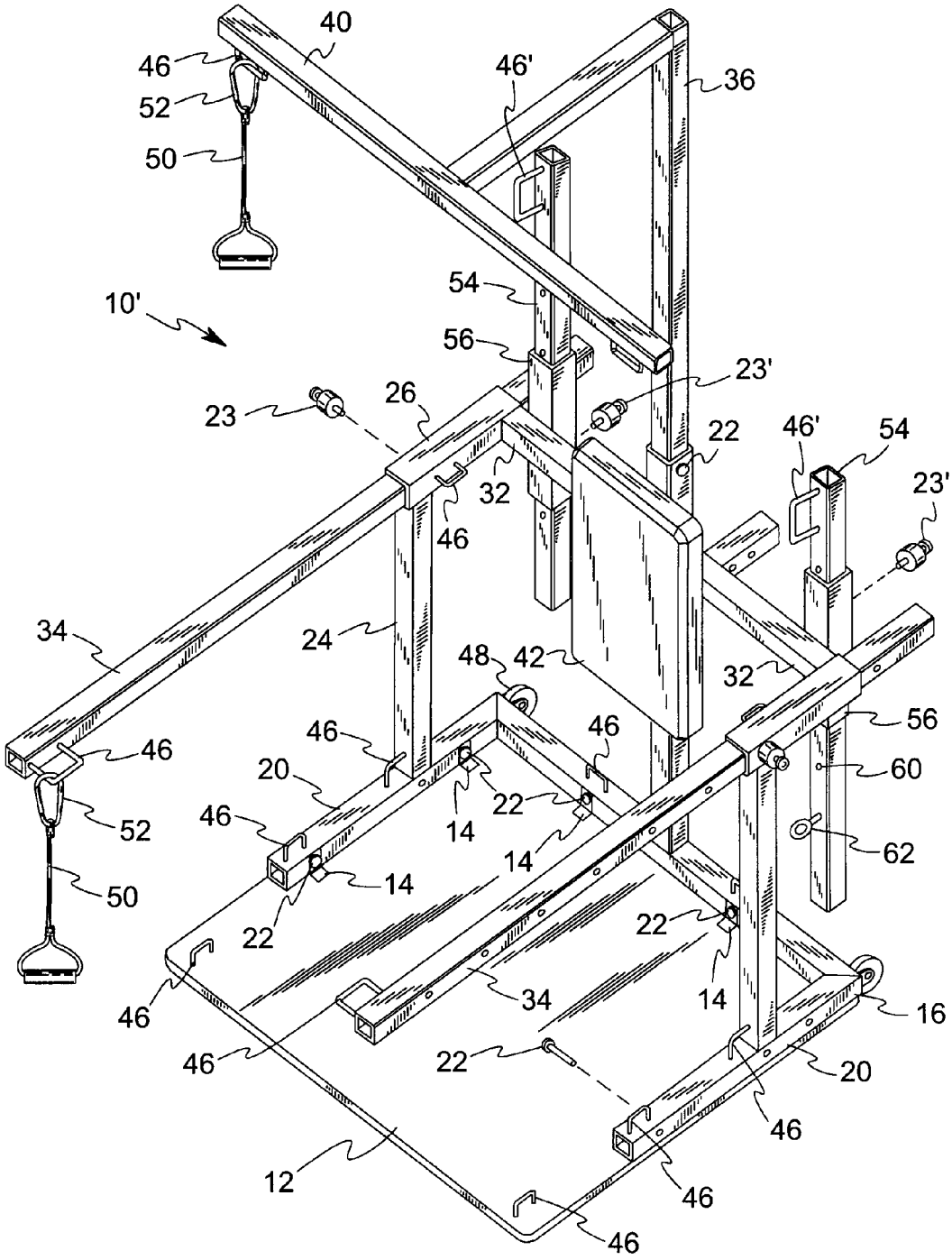
FIG. 3 is a view similar to FIG. 1, showing a second embodiment of the exercise frame.
Figure 4:
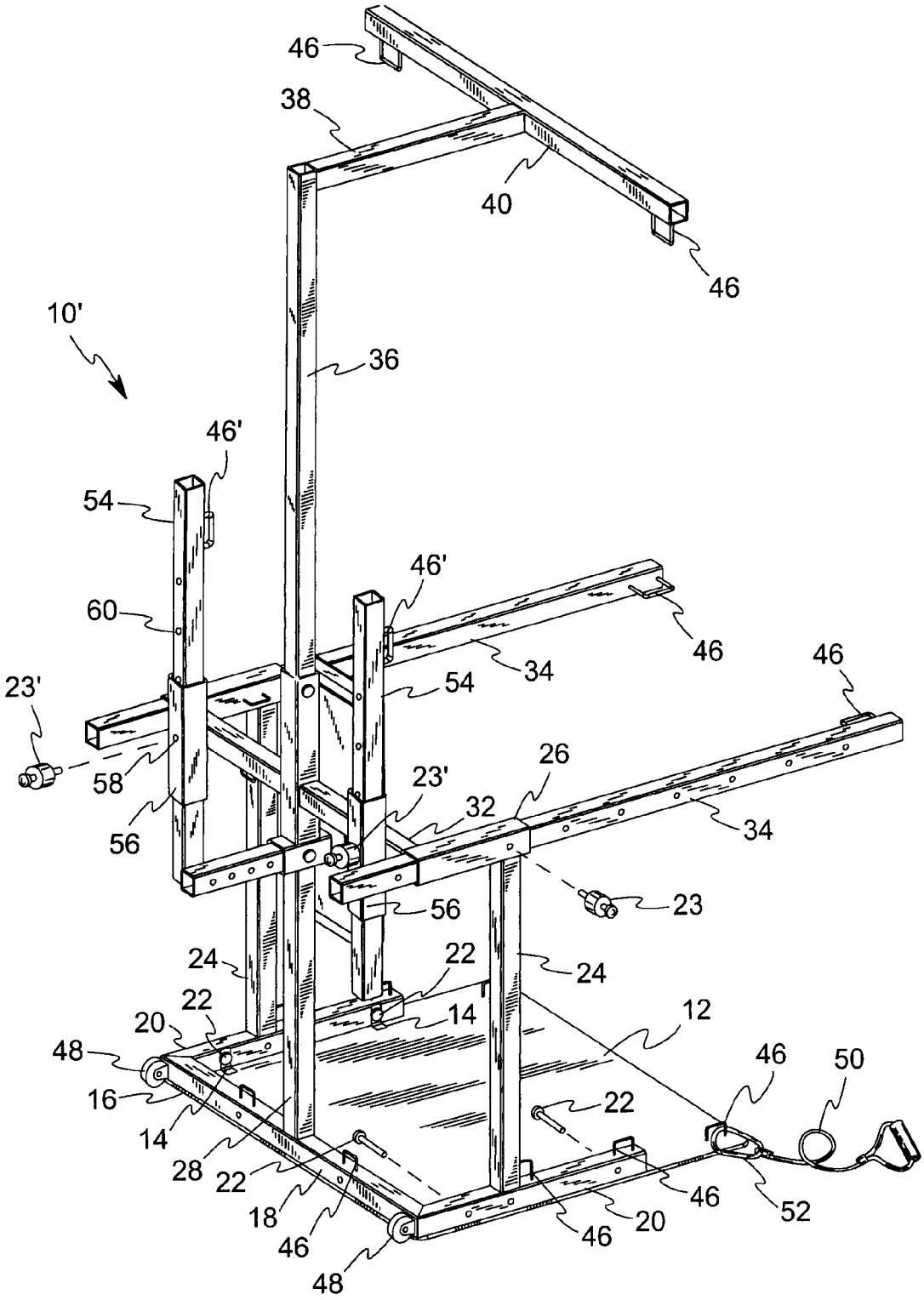
FIG. 4 is a view similar to FIG. 2, showing the second embodiment of the exercise frame.

FIGS. 3 and 4 show an exercise frame 10' that includes additional features. With respect to FIGS. 3 and 4, the same numbering will be used with respect to that seen in FIGS. 1 and 2 to refer to substantially similar features previously described.

The embodiment of FIGS. 3 and 4 expands upon the existing exercise frame 10 by providing high, midpoint, and low attachment points for elastic cords, located at approximately shoulder width of a user seated with his back toward the rear of the exercise frame 10'. Attachments at these locations increase the range of exercises that a user can perform from a stationary location, such as seated in a wheelchair located on the floor plate 12.

A pair of upwardly-and-downwardly slidable exercise bars 54 provides the additional attachment points. These bars 54 are located near the outer ends of the junction rods 32. First and second housings 56 provide suitably oriented passageways to receive the bars 54 for upward-and-downward movement and are welded to the junction rods. The orientation of the bars 54 and housings 56 will be described as being substantially vertical, for convenience of description but not as a limitation.

Each vertical housing is sized to telescopically or slidably receive a first or second vertical exercise bar 54. For clarity, the housings 56 are shown in the drawings to extend slightly above junction rod 32. It should be appreciated that the top end of housings 56 may terminate at or near the top surface of junction rods 32 so as to preserve the compact configuration of the base frame 16.

The housings 56 each define an aperture 58. Each vertical bar 54 defines a plurality of similar apertures 60 spaced along the length of a bar 54. For example, each bar 54 may carry five apertures spaced six inches apart, located in the center area of the bar. The apertures 60 are positioned on bar 54 to be alignable with aperture 58 on the housing 56 carrying the bar. The apertures 58 preferably are located on the rear of each housing 56. The apertures 60 may extend through both front and rear faces of each bar 54.

Apertures 56 and 60 can be accessed in aligned positions from the rear of exercise frame 10' for fastening the bars at variably selected heights. In the view of FIG. 3. the bar 54 to the right side is shown in a low position, while the bar 54 to the left side is shown in a high position. Fasteners 23', similar to fasteners 23 previously described, are suitable to mount the bars 54 at such variably selected heights in housings 56.

The front face of each vertical bar 54 carries an anchor 46' near the upper end of the bar 54. The position of the anchor 46' relative to the user is variable according to the selected height of the bar 54. Each bar 54 is about four feet in length. The anchor 46' is mounted a few inches below the upper end of the bar 54, such that the bar 54 can be adjusted to place the anchor at about the top of a housing 56 or upward to about three feet above the housing 56, thus locating the anchor to serve as midpoint to high attachment points for the elastic cords.

The plurality of apertures through bars 54 can temporarily receive a ring or anchor 62 to serve as another anchor point. Such a temporary anchor 62 is best used in a low aperture, located below the housing 56, to provide a low anchoring point. FIG. 3 shows such a temporary ring anchor 62 at a low position in bar 54 to the right side of this drawing figure. Together with the top anchor 46', the ring anchor 62 increases the available range of exercise for a user in a wheelchair, back against torso rest 42.

The user performs such exercise using the vertical bars 54 by pulling an elastic cord secured to anchor 46' or 62 with the user's back supported from backwards movement by pad 42. The use of housings 56 to slidably support the bars 54 preserves the ability of the exercise frame to be disassembled and transported in a car.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be regarded as falling within the scope of the invention as defined by the claims that follow.

What is claimed is:

1. A portable exercise frame, convertible between assembled and disassembled configurations, wherein the exercise frame in assembled configuration comprises:

a floor plate having first and second side edges, a rear edge, and a front edge;

a base frame carried on said floor plate with portions of the base frame establishing opposite, first and second side frames located near opposite, first and second side edges of the floor plate, and a rear frame located near a rear edge of the floor plate, together with said front edge of the floor plate defining an operator area suitably sized to receive thereon a user in a wheelchair, and wherein said front edge is open, allowing wheelchair entrance into said operator area on the floor plate with wheelchair in backed-in position;

said opposite, first and second side frames each including an upstanding portion carrying a respective first and second longitudinally elongated side housing located on respectively opposite sides of the operator area, spaced above the floor plate and defining a horizontal passage oriented from front-to-rear of the floor plate, spaced above the floor plate at approximately shoulder height of user seated in a wheelchair in said operator area, and positioned juxtaposed to said rear frame such that said side housings are proximate to the rear of the operator area;

first and second longitudinally elongated side exercise bars, each telescopically received in a respective one of said passages of said respective first and second side housings such that the side exercise bars are slidable between a selected forwardly extended position and a retracted position with respect to said side housings, wherein in the forwardly extended position a forward end of each side exercise bar extends forward of the front end of the floor plate so as to extend forward of and laterally spaced on each opposite side of a user in a wheelchair in back-in position on the floor plate;

said rear frame including first and second longitudinally elongated rear housings spaced above the floor plate and laterally near said first and second side frames, each defining a passage oriented substantially upwardly-and-downwardly with respect to the floor plate;

first and second longitudinally elongated rear exercise bars slidably received in said passages of said respective first and second rear housings such that the rear exercise bars are slidable between a selected upwardly extended position and a lowered position with respect to said rear housings;

exercise bar fastening means for releasably securing said side exercise bars and rear exercise bars in selected positions through the respective side and rear housings, chosen from a plurality of available positions;

a plurality of anchoring members configured suitably for, in use, attaching a resistance element to said exercise frame when the frame is in assembled configuration and suitable for hand engagement for carrying disassembled portions of the exercise frame when in disassembled configuration, wherein at least some of said anchoring members are mounted to the floor plate, to the base frame, to the side exercise bars, and to the rear exercise bars; and a body support member supported from and located forward of said rear frame and extending into said operator area from the rear frame, positionable to engage the back of a user in a wheelchair backed into the operator area.

2. An exercise frame, comprising:

a floor plate having right and left side edges, a rear edge, and a front edge;

a frame extending upward from said floor plate, having a rear portion, a right side portion, a left side portion, and an open front such that said floor plate defines an operator area with open front suitably sized to receive thereon a user in a wheelchair in backed-in position;

a torso support pad extending into said operator area from said rear portion of said frame at a suitable height above the floor plate to engage the torso of a user seated in a backed-in wheelchair in said operator area;

an adjustment bar carrying said torso support pad at a front end thereof and engaging the rear portion of the frame with a rear portion thereof;

an adjustable mechanism supporting said adjustment bar at a variably selected extension from the rear portion of the frame for supporting the torso support pad at a selectively variable forward position from the rear portion of the frame;

right and left side exercise bars, longitudinally elongated in a front-to-rear direction with respect to said floor plate and spaced apart such that the right exercise bar is disposed at the right edge of the floor plate and the left exercise bar is disposed at the left edge of the floor plate and are laterally separated on opposite edges of the operator area;

a right side housing joined to said right side frame portion near said rear frame portion, elevated above the floor plate at about shoulder height of a user seated in a wheelchair, defining a front-to-rear passage for telescopically receiving said right side exercise bar, and a left side housing joined to said left side frame portion near the rear frame portion, elevated above the floor plate at about shoulder height of a user seated in a wheelchair, defining a front-to-rear passage for telescopically receiving said left side exercise bar;

exercise bar fastening means for releasably securing said right and left side exercise bars in a selected position through the respective right and left side housings, chosen from a plurality of available positions;

wherein said exercise bars are slidable in said housings between a forward position wherein the fronts of the bars extend in front of the operator area for use in exercise by a user in a backed-in wheelchair and a rearward position wherein the fronts of the bars are retracted to near said respective side housings; and a plurality of apertured anchoring members positioned to extend peripherally from the front edge of the floor plate, the frame, and the right and left exercise bars, configured for, in use, attaching a resistance element to said exercise frame, wherein at least some of said anchoring members are mounted near the front edge of the floor plate, to the frame, and near the fronts of the right and left exercise bars.

* * * * *